US005680853A

United States Patent [19]

Clayton

[11] Patent Number: 5,680,853

[45] Date of Patent: *Oct. 28, 1997

[54] PROJECTILE LAUNCHING APPARATUS

[76] Inventor: Richard A. Clayton, 10200 Hillview Ave., Chatsworth, Calif. 91311

[ * ] Notice: The term of this patent shall not extend beyond the expiration date of Pat. No. 5,186,156.

[21] Appl. No.: 657,825

[22] Filed: Jun. 3, 1996

Related U.S. Application Data

[63] Continuation-in-part of Ser. No. 15,137, Feb. 9, 1993, Pat. No. 5,522,374, which is a continuation-in-part of Ser. No. 793,186, Nov. 18, 1991, Pat. No. 5,186,156.

[51] Int. Cl.[6] ..... F41B 11/14

[52] U.S. Cl. ..... 124/66; 124/59

[58] Field of Search ..... 124/45, 48, 56, 124/59, 63–67

[56] References Cited

U.S. PATENT DOCUMENTS

| | | | |
|---|---|---|---|
| 399,882 | 3/1889 | Graydon | 124/59 |
| 1,259,463 | 3/1918 | De Fir | 124/67 |
| 1,478,597 | 12/1923 | Bebler | 124/59 |
| 2,237,678 | 4/1941 | Lohr et al. | 124/66 |
| 3,009,453 | 11/1961 | Ayala | 124/27 |
| 3,111,121 | 11/1963 | Baggott | 124/67 |
| 3,205,883 | 9/1965 | Metcalf | 124/67 |
| 3,540,426 | 11/1970 | Lohr et al. | 124/67 |
| 3,818,887 | 6/1974 | Akiyama et al. | 124/67 |
| 3,913,553 | 10/1975 | Braughler | 124/73 |
| 4,004,565 | 1/1977 | Fischer et al. | 124/45 |
| 4,004,566 | 1/1977 | Fischer | 124/59 |
| 4,289,109 | 9/1981 | D'Andrade | 124/67 |
| 4,411,249 | 10/1983 | Fogarty et al. | 124/64 |
| 4,422,433 | 12/1983 | Milliman | 124/74 |
| 4,732,136 | 3/1988 | Ferri | 124/67 |
| 4,841,655 | 6/1989 | Ferri | 42/58 |
| 4,843,751 | 7/1989 | Ferri | 42/54 |
| 4,848,307 | 7/1989 | Tsao | 124/59 |
| 4,986,251 | 1/1991 | Lilley | 124/67 |
| 5,186,156 | 2/1993 | Clayton | 124/59 |
| 5,224,464 | 7/1993 | Burnham et al. | 124/67 |
| 5,522,374 | 6/1996 | Clayton | 124/59 |

*Primary Examiner*—John A. Ricci

*Attorney, Agent, or Firm*—Blakely, Sokoloff, Taylor & Zafman

[57] ABSTRACT

A mechanical projectile launcher utilizes novel cocking, advancement and indexing mechanisms for sequentially launching projectiles from a plurality of barrels. A linearly traveling handle is employed in the operations of both a firing mechanism and an advancement mechanism. A novel indexing mechanism utilizes a series of drive surfaces and alignment channels on a rotary element to allow a single advancement drive member, such as a pawl, to induce precise sequential alignment between a plurality of launching barrels and a firing mechanism, without the need for additional indexing members.

18 Claims, 3 Drawing Sheets

PROJECTILE LAUNCHING APPARATUS

This is a continuation-in-part of application Ser. No. 08/015,137 filed Feb. 9, 1993, now U.S. Pat. No. 5,522,374, which is a continuation-in-part of application Ser. No. 07/793,186, filed Nov. 18, 1991, now U.S. Pat. NO. 5,186,156. This specifications of said co-pending application and said issued patent are incorporated herein by reference. This application also relates to information in Disclosure Document No. 342907, filed Nov. 15, 1993.

BACKGROUND OF THE INVENTION

The present invention relates to mechanical guns and more particularly to air operated guns with repeating capability, and associated cocking and magazine advancement mechanisms.

Various repeating airguns and the like are known in the art in which the actuation of firing and magazine advancement mechanisms is achieved via force applied by an operator to one or more movable handles. In such guns, direct manipulation of the handles by an operator is translated by various linkages to operative mechanical activity of the gun. Some known airguns comprise a magazine having a plurality of projectile launching barrels, and an air pump having a plunger which is movable to compress air within a chamber. Examples are found in U.S. Pat. Nos. 2,237,678 (Lohr et al), 3,540,426 (Lohr et al), 4,841,655 (Ferri), and 4,848,307 (Tsao). The Lohr and Ferri references use pivoted handles to actuate cocking and advancement mechanisms. Tsao uses a linearly sliding handle to cock an integral plunger, but uses a second, pivoted handle in the form of a typical trigger to actuate magazine advancement. None of the cited references suggests the use of a manually operated, linearly traveling handle for simultaneously cocking the air pump and advancing the magazine.

U.S. Pat. Nos. 4,843,751 (Ferri), 4,732,136 (Ferri), 3,818,887 (Akiyama et al.), and 3,111,121 (Baggott) disclose airguns in which plungers are cocked using various forms of linearly traveling handles. Ferri '751 and Ferri '136 disclose repeating airguns in which a linearly traveling handle takes the general form of a trigger to be squeezed toward a pistol grip. None of the references suggests utilization of a linearly traveling trigger or handle to advance a multiple-barrel magazine.

Akiyama '887, cited above, and U.S. Pat. No. 4,289,109 (D'Andrade) disclose hollow handle assemblies, utilized to cock an air pump, which are carried for linear, longitudinal travel about an elongated portion of a gun frame, Neither reference suggests incorporation of an magazine advancement member or linkage which would allow the handle to provide driving force for an advancement mechanism within the gun frame.

U.S. Pat. No. 2,625,927 (Rosenbloom) discloses a magazine advancement mechanism in a toy revolver in which a pawl engages a drive surface on a cylindrical magazine to induce rotation of the magazine. However a separate projecting member 38 of the trigger is required to engage another surface 37 on the magazine to prevent further rotation. Thus the pawl is only capable of imparting motion to the magazine and is not able to stop rotation or hold the magazine in a desired alignment.

U.S. Pat. No. 5,156,137 (Clayton) discloses a magazine advancement mechanism in which a guide surface becomes aligned with the path of a pawl and engages the pawl to prevent forward rotation of a magazine, but a separate detent is required to prevent reverse rotation and maintain alignment between a barrel and the hammer of a firing mechanism.

SUMMARY OF THE INVENTION

The present invention provides new constructions for mechanical guns wherein a linearly traveling handle is utilized in the operations of both a firing mechanism and an advancement mechanism for sequentially launching projectiles from a plurality of barrels.

In some embodiments of the invention, a linearly traveling handle is employed to cock the plunger of an air pump in preparation for firing, i.e., discharge of air from the pump. The linearly traveling handle is also used to drive a magazine advancement mechanism for sequentially transporting a plurality of projectile launching barrels into alignment with the pump's discharge port. The invention's novel utilization of a linearly traveling handle to actuate both cocking and advancement functions allows the construction of air powered toy projectile launchers which more realistically simulate, with respect to the prior art, firearms such as a pump action shotgun or a semi-automatic pistol. The invention further facilitates the construction of novel air powered repeating projectile launchers such as a toy bow and arrow or a crossbow, in which a large linear displacement of the operator's hand would normally be associated with drawing a bowstring rearward. When constructed in accordance with the present invention, such devices may translate the motion of a linearly traveling handle into driving force for an advancement mechanism, while simultaneously using the handle to operate the plunger of an air pump.

In other embodiments of the invention, a linearly traveling handle is incorporated in the general form of a trigger to be squeezed toward an opposing pistol grip type handle. In addition to operating a firing mechanism, the trigger-like handle is provided with an advancement driving member which cooperates with other elements of an advancement mechanism to translate linear travel of the trigger to driving force for the advancement mechanism.

The present invention further provides a novel mechanism for driving and indexing a rotary magazine advancement element to successively align a plurality of projectile launching barrels with a firing mechanism. The rotary element may be incorporated in a cylindrical magazine for a revolver or in a drive sprocket for a belt fed projectile launcher. The rotary element is similar to the advancement mechanisms of many prior art revolvers, in that it comprises a series of drive receiving surfaces on the magazine (or other rotary element) symmetrically spaced about an axis of rotation, whereby a pawl or similar driving device can engage a selected surface, and whereby substantially linear travel of the pawl causes the magazine to rotate. In the prior art, a member of a pivoted trigger is often engaged with another series of surfaces on the rotary element to stop rotation and to maintain the necessary operational alignment of the rotational element as the firing mechanism is actuated. Such functions become more difficult to incorporate in designs where a typical pivoted trigger is not available for advancement and alignment operations. Examples may be found in the art where a separate spring biased detent or other device is required. The present invention obviates the need for such separate detents and indexing devices by employing guide surfaces on the rotary element which are designed to become longitudinally aligned with the linear path of travel of the pawl as the rotary element reaches a point of desired operational alignment. The rotation stopping and alignment functions are provided by the pawl engaging the guide surfaces to oppose forward and reverse rotary motion of said surfaces. The result of the invention is a very simple yet highly accurate advancement and alignment mechanism.

The mechanism is particularly well suited for use with a linearly displaced operating handle or trigger since it is only necessary that the handle cooperate with a single pawl to induce both the rotational and the alignment functions.

Therefore, it is among the objectives of this invention to provide novel constructions for air operated repeating projectile launchers in which a linearly traveling handle is utilized to both cock an air pump and to drive or otherwise actuate an advancement mechanism.

It is further among the objectives to provide such projectile launchers wherein the linearly traveling handle takes the form of a trigger to be squeezed against a pistol grip.

Another objective is to provide a novel advancement mechanism wherein a cylindrical magazine or similar rotary element is advanced, stopped and aligned by cooperative interface with a single pawl or similar drive element.

Another objective is to provide an advancement mechanism wherein a multi-barrel magazine is advanced by a pawl, for sequentially aligning the barrels with an air discharge port or outlet, and wherein the pawl additionally is able to drive the magazine away from the air outlet for reduced friction between the magazine and the outlet during advancement.

BRIEF DESCRIPTION OF THE DRAWINGS

The present invention, both as to its organization and manner of operation, together with further objects and advantages thereof, may best be understood with reference to the following description, taken in connection with the accompanying drawings in which.

DESCRIPTION OF EXEMPLARY EMBODIMENTS OF THE INVENTION

Figure 1:
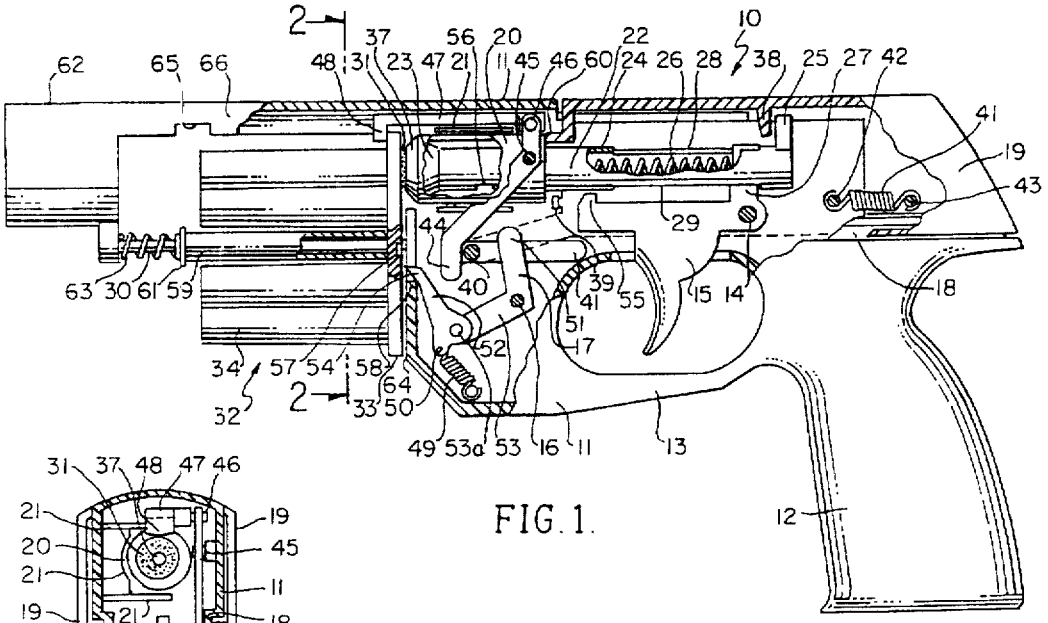
FIG. 1 is a side elevational view, partly in section, of a novel mechanical gun incorporating elements of the present invention.

Referring to FIG. 1, there is shown by way of illustration, but not of limitation, a mechanical pistol 10 designed and constructed in accordance with this invention. The pistol includes a hollow frame 11, having a "pistol grip" handle 12, a trigger guard 13, a shaft 14 for pivotally mounting a trigger 15, a shaft 16 for pivotally mounting a magazine advancement lever assembly 17, and an elongated portion having guides 18 for carrying a hollow sliding handle assembly 19 for generally straight linear travel between a forward position and a rearward position about the elongated portion of the frame. (The term "assembly" is used in this case to describe a device comprising a plurality of functional members, but it is to be understood that the device may be assembled from a plurality of parts or it may be molded or otherwise formed as a single piece.) Carried within the frame 11 are a cylinder 20, and a plunger 22. The plunger comprises a piston 23, and a hollow shaft 24 having a protruding shoulder 25. Both the cylinder 20 and plunger 22 are movably carried for forward and reverse travel longitudinally within the frame 11. Interior members 21 of the frame 11 provide support for the cylinder 20. A spring 26 is carried within the plunger 22 such that one end of the spring rests at the forward end of the hollow shaft 24 and the other end of the spring 26 rests against an arm 27 of trigger 15 which protrudes into the interior of the hollow shaft 24 through a pair of slots 28, 29. In its uncocked state, as depicted in FIG. 1, the plunger 22 is in its most forward position so that the arm 27 is near the rearward end of the hollow shaft 24.

Figure 2:
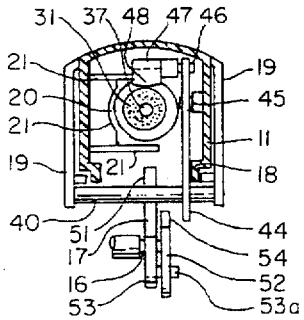
FIG. 2 is an end elevational view, partly in section, of the frame and magazine advancement and engagement mechanisms of the mechanical gun of FIG. 1.
Figure 7:
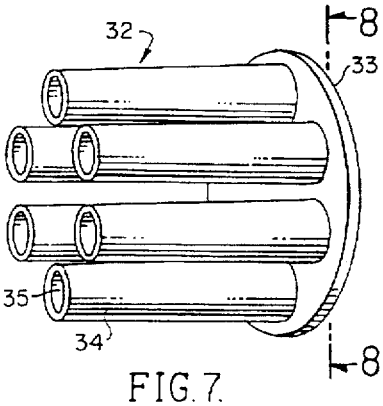
FIG. 7 is a perspective view of a cylindrically configured rotary style projectile magazine incorporating elements of the present invention.
Figure 8:
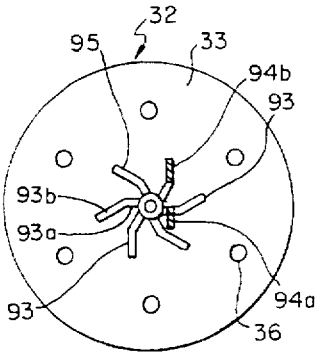
FIG. 8 is an end view of the magazine of FIG. 7 taken in the direction of arrows 8—8.

A projectile magazine 32 is rotatably carried by a shaft 30 on the frame 11 which supports a tubular bearing 59 of the magazine 32. In this embodiment of the invention, the magazine is able to slide forward and rearward on shaft 30, and is normally urged rearward by the bias of a spring 63. A washer 61 prevents the bearing 59 from dragging against the spring 63. The magazine 32 comprises a baseplate 33 to which a plurality of elongated barrels 34 are attached. A similar magazine is shown in greater detail in FIGS. 7 and 8. This and other magazine embodiments will be described in depth later in this specification. With reference to FIGS. 1, 7 and 8, each barrel 34 has a central passageway 35, open at both ends. The rearward opening 36 is of smaller diameter than the passageway 35 to provide a stop for a projectile to be inserted from the forward end, and for ease of alignment with a gasket 31 at the outlet 37 of cylinder 20 (refer also to FIG. 2). Each barrel is able to carry a projectile so as to form a generally airtight seal, as will be described in greater detail later in this specification.

In FIG. 1 the sliding handle assembly 19 is shown in its forward, or rest, position, being biased to this position by the force of a spring 41 which is engaged between a shaft 42 on frame 11 and a shaft 43 at the rearward end of sliding handle assembly 19. A shaft 40 at the forward end of sliding handle assembly 19 protrudes to the interior of frame 11 through a pair of slots 41 to engage a lever 44 which is pivotally carried by a shaft 45 on the frame 11. The opposite end of the lever 44 is pivotally attached by a shaft 46 to a clamping arm 47. A protrusion 48 on the forward end of the clamping arm 47 engages baseplate 33 of the magazine 32 to draw the baseplate 33 rearward for sealing engagement with gasket 31 of the cylinder 20. It is noted that sealing force is derived from the bias of spring 41, which, in this embodiment of the invention, actuates the magazine clamping mechanism as previously described, and additionally forces a shoulder 60 on sliding handle assembly 19 into engagement with cylinder 20 to drive the cylinder forward.

The pistol 10 is cocked and the magazine 32 is advanced as follows: An operator holds the pistol grip 12 with one hand and draws the sliding handle assembly 19 rearward with his/her other hand. A shoulder 38 on the interior surface of the sliding handle 19 engages the shoulder 25 of the plunger 22 causing the plunger to travel rearward within frame 11, thereby compressing spring 26 against arm 27 of trigger 15. As the plunger 22 moves rearward, friction between the piston 23 and the interior surface of cylinder 20 drags cylinder 20 rearward such that the forward end of cylinder 20 is urged away from baseplate 33 of the magazine 32. A protruding member 39 on the frame 11 limits rearward movement of the cylinder 20 to a minimum whereby friction between the baseplate 33 and the gasket 31 is acceptably reduced without allowing lost motion to excessively shorten the effective stroke of the piston 23 within the cylinder. To further reduce friction between magazine 32 and cylinder gasket 31, as the sliding handle assembly 19 moves rearward, shaft 40 is disengaged from lever 44, thereby removing clamping force from arm 47 and relaxing the hold of protrusion 48 on baseplate 33. Additionally, the shaft 40 on sliding handle assembly 19 then engages the upper member 51 of the magazine advancement lever assembly 17. As the sliding handle 19 is drawn further rearward the shaft 40 pivots the lever assembly 17 about shaft 16. A pawl 52, pivotally mounted by shaft **53*a* to the lower member 53 of lever assembly 17, is raised upward whereby the tip 54 of pawl 52 engages a slot 57 in baseplate 33 to force the slot 57 upward, thereby rotating magazine 32 for successive alignment of barrels 34 with the air cylinder outlet 37. The pawl as shown in FIG. 1 normally rests against a point 58 on the frame 11 to prevent it from interfering with manual rotation of the magazine for loading. When the pawl 52 is raised upwardly by lever assembly 17, a spring 49 exerts force on a member 50 of the pawl 52 to pivot the pawl 52 forwardly for engagement with baseplate 33. As the lever assembly 17 pivots further, reactive force of the upper edge of slot 57 against tip 54 further urges the pawl 52 to pivot forwardly, thereby reinforcing engagement of the pawl 52 to the baseplate 33 and driving the magazine 32 forwardly on shaft 30, against force of spring 63, to further ensure acceptable disengagement between baseplate 33 and cylinder gasket 31. The forward movement of magazine 32 also prevents drag between the magazine and the forward bulkhead 64 of frame 11**.

As mentioned above, resistance of the magazine 32 to driving force from the pawl 52 causes the magazine to exert reactive force on the pawl. The relationship between the pawl 52 and lever assembly 17 that allows the pawl to pivot into harder engagement with the magazine in response to resistance of the magazine to driving force is as follows: The lever assembly 17 is carried about a fixed shaft 16 on the frame. The pivotal mounting shaft **53*a* for the pawl is thus restricted to an arcuate path of operative travel. Lever member 53 is positioned to normally extend slightly downward and in the direction of the magazine so that as it swings upward through its operative path the shaft 53*a* has substantial vertical displacement and relatively little horizontal displacement. The pawl 52 is carried by the lever 53 at an angle with respect to the magazine baseplate 33 so that it extends from its pivot 53*a* both in the direction of operative travel of the pawl (i.e., the direction the pawl travels to rotate the magazine, or upward in FIG. 1) and in the direction of the magazine (to the left in FIG. 1). Herein the phrase "in the direction of the magazine" is intended to denote a direction toward the magazine and parallel to the longitudinal axes of the barrels 34. The direction of operative travel of the pawl lies in a plane orthogonal to the barrel axes and is therefore perpendicular to the direction of the magazine. With further reference to FIG. 1 it can be observed that force applied to the pawl tip 54 in the direction opposite that of operative pawl travel will urge the pawl to pivot or rotate in the counter-clockwise direction about its carriage on lever 53. Resistance of the magazine to driving force from the pawl will exert force on the pawl tip opposite the direction of operative travel and will urge the pawl to pivot as described above. Such pivoting of the pawl requires that tip 54 be displaced forwardly, since horizontal movement of pawl pivot 53*a* is small relative to its vertical movement. However, the required forward displacement of tip 54 is prevented by engagement with baseplate 33 when the magazine is in its normal rearward position as in FIG. 1. If magazine resistance is great enough, continued advancement motion of the lever assembly 17 will force the pawl to press harder in the forward direction against baseplate 33 until it overrides the bias of spring 63, whereby the magazine is displaced in the forward direction to allow the pawl to pivot. At some point in the forward displacement of the pawl tip 54 and magazine 32**, frictional resistance to rotation of the magazine will become sufficiently reduced for rotation to begin, with a portion of drive force from the pawl being directed toward outward displacement of the magazine and a portion of the force directed toward rotation.

As the sliding handle 19 reaches its most rearward position, the plunger 22 also reaches its most rearward position whereby a hook 55 on the trigger 15 becomes aligned with a hole 56 in the hollow shaft 24. Compression of the spring 26 against arm 27 pivots trigger 15 about shaft 14 such that the hook 55 engages the rim of the hole 56 to prevent the plunger 22 from moving in the forward direction when the sliding handle 19 is returned forward. Spring 41, having been stretched by the rearward travel of the sliding handle 19, serves to return the sliding handle 19 forward upon release by the operator. As the sliding handle 19 approaches its forwardmost position, spring 49 pulls pawl 52 downward and out of magazine engagement, spring 63 again urges magazine 32 rearwardly, shaft 40 again actuates the clamping mechanism of lever 44 and arm 47, and shoulder 60 on the sliding handle again urges the cylinder 20 forward to form a generally airtight seal between the cylinder gasket 31 and magazine baseplate 33, and to form a continuous air channel comprising air cylinder outlet 37 and passageway 35 of the barrel 34 currently in firing alignment with gasket 31.

Figure 3:
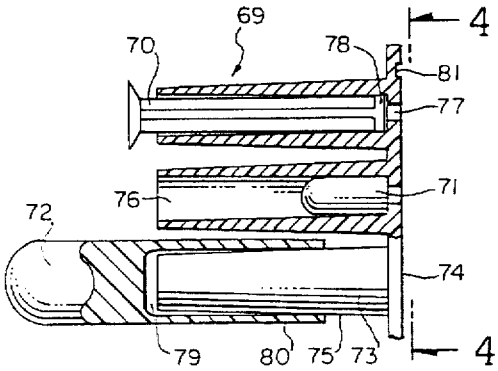
FIG. 3 is a side elevational view, partly in section, of a linearly configured clip style projectile magazine incorporating elements of the present invention.

Once cocked, the pistol 10 may be fired by pivoting the trigger 15 about shaft 14 to disengage hook 55 from hole 56 thus allowing the compressed spring 26 to expand, thrusting plunger 22 forward to force air out of cylinder 20 and through passageway 35 to discharge a projectile, such as 70, 71 or 72 in FIG. 3, from the barrel 34. Friction between plunger head 23 and the interior surface of cylinder 20 urges cylinder 20 forward, thus reinforcing the seal between cylinder 20 and barrel 34. After firing, the pistol 10 may once again be cocked and the magazine advanced as previously described.

A barrel extension 62 is carried at the forward end of the frame 11 for cosmetic purposes. The inside diameter of the barrel extension 62 is intended to be larger than the diameter of the projectiles used with the gun such that no contact is made between the projectile and the barrel extension 62 at any time before, during or after projectile launch. Notches 65 are provided in the support 66 between the barrel extension 62 and the frame 11 to allow clearance during magazine advancement for projectiles, similar to 71 of FIG. 3, which have enlarged suction cup type heads.

Figure 4:
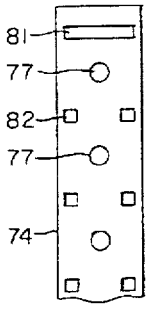
FIG. 4 is an end view of the magazine of FIG. 3 taken in the direction of arrows 4—4.

Referring to FIGS. 3 and 4, an embodiment of the projectile magazine of the present invention is shown. The magazine 69 comprises a plurality of individual tubular barrels 73 supported and joined together in a linear, side by side, parallel spaced configuration by an elongated baseplate 74. The baseplate 74 attaches to each barrel 73 generally orthogonally to the central longitudinal axis of the barrel. The use of individual tubes for the barrels 73, allows the barrels to be widely spaced with a minimum of material being required, since the areas between adjacent barrels 73 are for the most part devoid of material. Additionally, the use of individual tubes allows the magazine 69 to be used with hollow projectiles such as 72 which may be carried on the exterior surface 75 of a barrel 73. The magazine 69 is preferably formed, by a plastic molding or other suitable process, as a single piece comprising a plurality of barrels 73 and the supporting baseplate 74. The magazine as shown may be formed using a two piece mold which separates in the forward and rearward directions (left and right, respectively, in FIG. 3). A primary advantage of the single piece molded construction is the reduction of assembly requirements for the magazine 69.

The magazine 69 of FIGS. 3 and 4 is depicted in fragmentary form with three barrels 73 arranged in a linear parallel spaced configuration, stacked one on top of another, but it is understood that other than practical considerations such as size and structural integrity, there are no limits to the number of barrels 73 which may be so joined together.

A variety of projectile types, such as 70, 71 and 72, may be carried and launched by magazine 69. A common requirement for good launching distance is that the projectile be capable of blocking airflow through the barrel's central passageway 76 sufficiently for pressurized air delivered into the passageway 76 through a rearward opening 77 to eject the projectile from the barrel 73. This requirement is referred to herein as a "generally airtight seal". Projectile 70 achieves the aforementioned generally airtight seal with a circular piston 78 at its rearward end which is generally complementary to the cross-sectional shape and dimensions of the barrel's internal passageway 76. Projectile 71 is bullet shaped, having cross-sectional dimensions similarly matched to the internal passageway. Projectile 72 has a hollow interior 79 with the surrounding walls 80 being sized to slide snugly over the exterior surface 75 of a barrel 73. In the embodiment of FIG. 3, the inside diameter of each barrel 73 is reduced from front to rear in a tapered manner, and the outside diameter of each barrel 73 is reduced from rear to front in a tapered manner. This allows the greatest seal between a barrel 73 and an internally carried projectile 70, 71 or an externally carried projectile 72 to be achieved when the projectile is positioned rearwardly in or on the barrel 73. As the projectile is moved forwardly, the contact friction between barrel 73 and the projectile is reduced to allow compressed air delivered through opening 77 to freely accelerate and discharge the projectile from the barrel. It is understood that while the barrels 73 of FIG. 3 are shown to be tapered, a similar reduction of exterior and interior diameters may be achieved in a stepwise manner, or the barrels may be formed with uniform diameters over their length.

Figure 13:
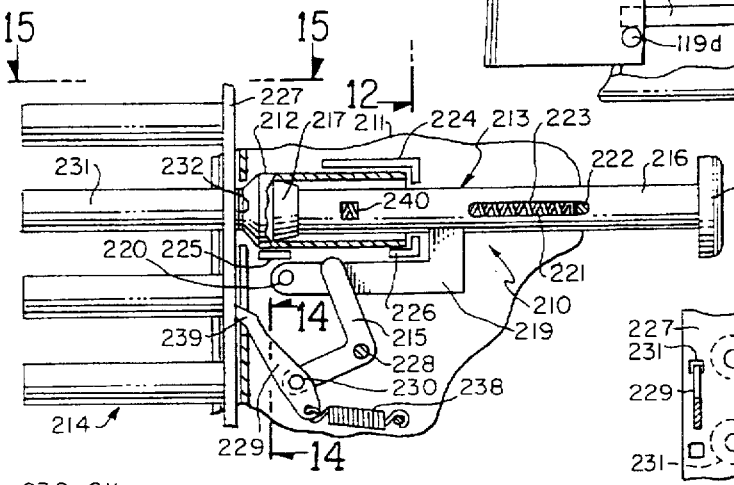
FIG. 13 is a fragmentary side view, partly in section, of a novel projectile launching apparatus employing elements of the present invention.

The magazine 69 is provided with recesses 81, 82 in baseplate 74, the edges of which function as ratchet surfaces for engagement with magazine advancing means on a cooperating projectile launching apparatus. An example of such an apparatus is shown in FIG. 13. The features and operation of this apparatus will be further described later herein. Note that the recesses 81, 82 are configured to be symmetrical about the central longitudinal axis of baseplate 74 so that either end of such a magazine may be initially inserted into a firing apparatus.

Figure 5:
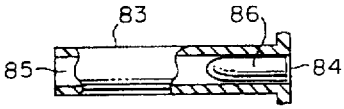
FIG. 5 is a side view, partly in section, of a projectile barrel configuration which may be employed in embodiments of the present invention.

The barrels 73 in FIG. 3 are shown with a rear opening 77 that is of smaller diameter than the passageway 76, so that a projectile 70, 71 inserted from the forward end of the barrel is prevented from protruding or exiting through the opening 77. In some embodiments of the invention, it will be desirable to load projectiles into a barrel from the rearward end. A barrel 83 adapted for rear loading is shown in FIG. 5. The barrel 83 comprises a rear opening 84 having generally the same diameter as the barrel's inner passageway 85, so that a projectile 86 having a similar cross-sectional diameter may be inserted through the opening 84.

Figure 6:
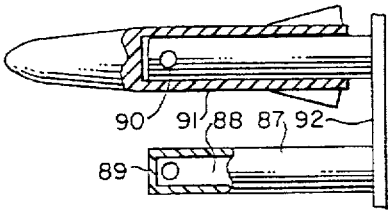
FIG. 6 is a side elevational view, partly in section of a variation on the magazine of FIG. 3.

Another barrel configuration is shown in FIG. 6 in which the barrels 87 comprise a central passageway 88 which is sealed longitudinally at the forward end 89, with outlets 90 arranged for radial or side discharge. This configuration is designed for use only with externally carried projectiles, such as a hollow, rocket shaped projectile 91. The sealed end 89 of the longitudinal path through the passageway 88 adds a measure of safety against foreign objects being inserted or discharged. As in the previously described magazines, the barrels 87 are supported and joined together by a baseplate 92.

FIGS. 7 and 8 depict an embodiment 32 of the projectile magazine of the present invention in which the barrels 34 are supported and joined together by a wheel or baseplate 33 in a cylindrical parallel spaced relationship. The magazine is similar to that employed by the gun 10 of FIG. 1. As with the previously described linearly arranged magazine 69, the cylindrical magazine 32 is preferably molded or otherwise formed as a single piece comprising a plurality of barrels 34 and the baseplate 33. As with the linear magazine 69, the cylindrical magazine 32 may be formed using a two piece mold which separates in the forward and rearward directions. The passageways 35 within the barrels 34 open to the rear through openings 36 in the baseplate 33. The baseplate or wheel 33 is provided with indexing slots 93 for engagement with a driving member of a magazine rotating advancement mechanism, such as the magazine advancing pawl 52 of FIG. 1. The indexing slots 93 comprise a set of guides which co-act with an advancement driving member such as pawl 52 to advance the barrels. Each slot or indexing guide set 93 comprises a drive surface **93*a* which receives force from the driving member to rotate the wheel 33. Each slot or guide set further comprises an alignment channel 93*b*, formed by sides 95, which co-acts with the driving member to hold wheel 33 in proper alignment for firing and to prevent both forward and reverse rotation of the wheel. In FIG. 8, the tip of a pawl or other such driving member is represented by numbers 94*a* and 94*b*. In the position of 94*a*, the pawl laterally engages a drive surface 93*a* of a slot 93. As the pawl is moved upward toward the position of 94*b*, magazine 32 is forced to rotate to maintain engagement of the pawl and slot 93. When the pawl reaches the position of 94***b*, the sides 95 of the slot 93 will have been rotated into longitudinal alignment with the path of operative travel of the pawl. The longitudinal alignment of the sides 95 with the path of the pawl serves to prevent further travel of the pawl from exerting rotary force on the wheel 33. Assuming the pawl is constrained from sideways movement, engagement of the pawl with sides 95 in said alignment additionally serves to stop forward rotation of the magazine and to prevent rearward rotation of the magazine. Thus the pawl 94*a*, 94*b* and slots 93 cooperate to both advance and index the magazine, with no other interaction being required between the magazine and an advancement or indexing mechanism. This provides a simple yet accurate means for aligning the barrels 34 with an air outlet or other firing mechanism interface element.

Figure 10:
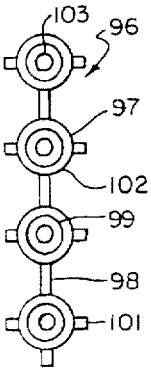
FIG. 10 is an end view of the magazine of FIG. 9 taken in the direction of arrows 10—10.
Figure 9:
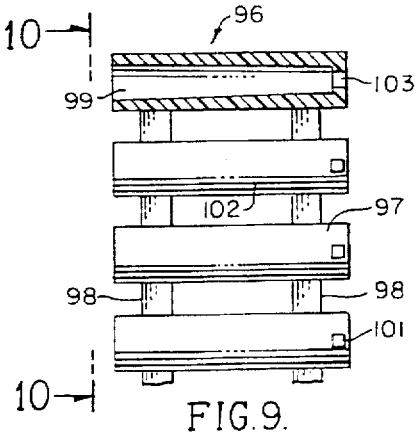
FIG. 9 is a side elevational view, partly in section, of a linearly configured belt style projectile magazine incorporating elements of the present invention.

FIGS. 9 and 10 depict another embodiment 96 of the projectile magazine of the present invention in which a plurality of barrels 97 are joined in a linear parallel configuration by support members 98 which attach to the barrels 97 and provide structural support generally parallel to the central longitudinal axes of the barrels 97. Such a configuration may be employed to simulate a belt type machine gun magazine. Preferably the magazine is molded or otherwise formed as a single piece from flexible plastic whereby the magazine is resiliently bendable between adjacent barrels 97, while the support members 98 maintain parallel alignment between adjacent barrels 97. As with the previously described magazine embodiments, each barrel 97 comprises a central passageway for carrying a projectile, such as 70 or 71 of FIG. 3, and a rearward opening 103 for receiving compressed air from the outlet of a cooperating air cylinder. Each barrel 97 is provided with protruding tabs 101 which may be engaged by magazine advancing and indexing means of a cooperating projectile launching apparatus. Additionally, the sides 102 of the barrels may be engaged by magazine advancing and indexing means, such as a sprocket or pawl.

Figure 11:
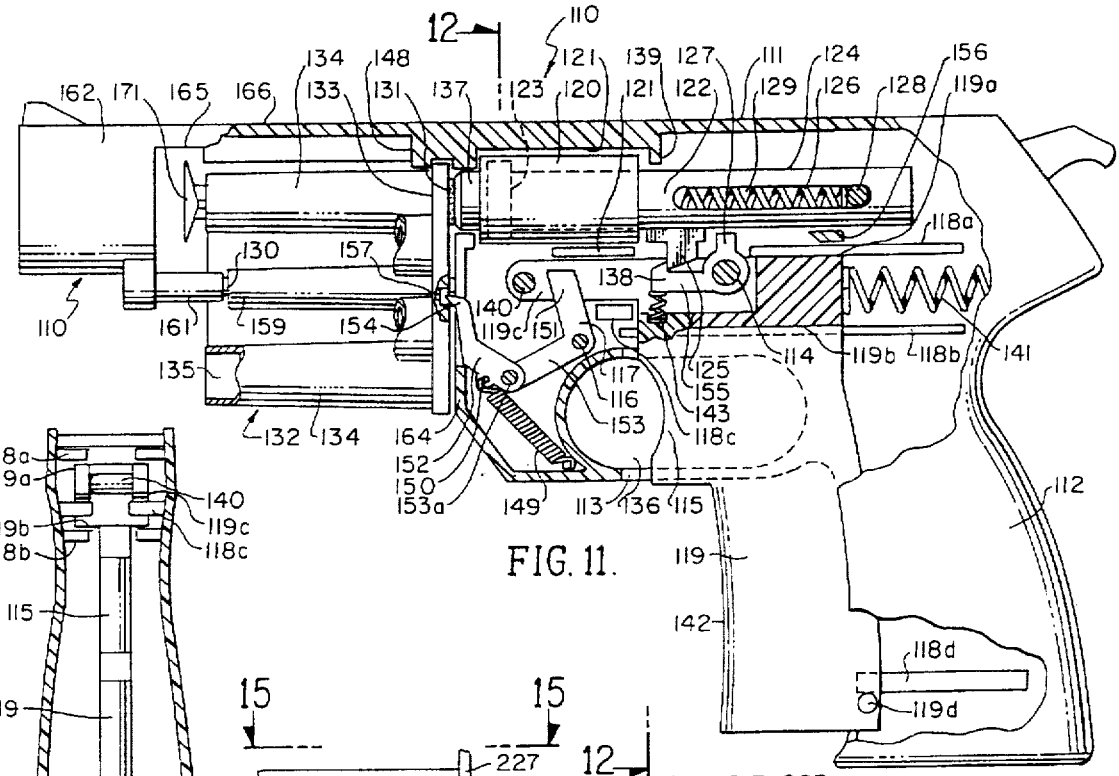
FIG. 11 is a side elevational view of a novel mechanical gun which incorporates a linearly traveling handle assembly as a trigger for actuating an air pump and a magazine advancing mechanism.
Figure 12:
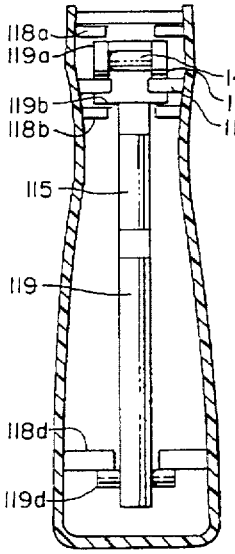
FIG. 12 is a fragmentary elevational view of the frame and trigger of the gun of FIG. 11, taken in the direction of arrows 12—12.

FIG. 11 shows an embodiment 110 of the present invention, which is a variation on the pistol 10 of FIG. 1. In the gun 110, the previously described cocking and magazine advancement features of the sliding handle 19 are incorporated into a sliding handle assembly 119 which simulates the trigger of a conventional gun. The gun 110 comprises a frame 111 in the general form of a pistol, having a portion 112 in the form of a pistol grip, a trigger guard 113, a shaft 116 for pivotally mounting a magazine advancement lever 117, and guides 118*a, b, c, d* for slidingly supporting a handle assembly 119, at surfaces 119*a, b, c, d*, for reciprocating travel between a forward rest position and a rearward firing position. Carried within the frame 111 are an air cylinder 120 and a plunger assembly 122 similar to corresponding elements previously described for FIG. 1. The cylinder 120 is supported by guides 121 for sliding movement between a forward position and a rearward position, with its travel limited by a shoulder 139 of frame 111. The plunger 122 is likewise supported for forward and rearward movement: at its rearward end by a shaft 128 which protrudes from the frame 111 through slots 129 in the hollow plunger shaft 124, and at its forward end by piston 123 which slides against the interior surface of cylinder 120. A spring 126 is carried within hollow shaft 124, with its forward end in contact with the forward end of hollow shaft 124 and its rearward end contacting shaft 128 which is fixed to the frame. The plunger 122 also comprises a protruding sear 125 for engagement with the hooked end 138 of a pawl 155 pivotally carried by sliding handle assembly 119 about a shaft 114. A cylindrically configured projectile magazine 132, similar to that of FIGS. 7 and 8, is rotatably carried on frame 111 at a breech area forward of the pistol grip 112 and air chamber 120. The magazine 132 comprises a tubular bearing 159 which is rotatable about a shaft 130. Note that in this embodiment, the forward movement of the magazine 132 is restricted by a portion 161 of shaft 130 having an enlarged diameter, and by a shoulder 148 protruding from the frame 111. The slidable, spring biased magazine configuration of FIG. 1 (ref spring 63) could also be implemented in this embodiment, but it has been omitted from this design for simplicity and reduction of parts. Note also that the clamping mechanism of FIG. 1 (ref lever 44 and arm 47) is not implemented in the embodiment of 110. The sliding handle assembly in embodiment 110 is in its most rearward position when plunger 122 is released for a firing stroke, as will be explained in further detail, and thus is not available to actuate such a clamping device. Therefore, in the gun 110 of FIG. 11, intermittent engagement and disengagement of the air cylinder gasket 131 to the magazine baseplate 133 is facilitated by forward and rearward movement of cylinder 120 in response to forward and rearward movement of piston 123 within the cylinder 120.

The gun 110 of FIG. 11 is cocked and fired as follows: an operator inserts an index finger through an opening 136, in the frame 111 above the trigger guard 113, to grasp a member 115 of sliding handle assembly 119 which simulates a conventional finger operated trigger. The operator's thumb is wrapped around the pistol grip 112, and the remaining fingers of the hand are used to grasp the lower portion 142 of sliding handle 119, which extends out from the frame 111 below trigger guard 113. The lower portion 142 of the sliding handle may be omitted without deviating from the spirit of the present invention, however its inclusion provides for easier cocking and firing of the gun, particularly by a child who may have difficulty compressing spring 126 with the strength of a single finger. The operator, with hand positioned as described, now pulls the sliding handle assembly 119 rearward on the frame 111. As the sliding handle 119 moves rearward, hook 138 of pawl 155 engages sear 125 to draw plunger assembly 122 rearward, which in turn causes piston 123 to draw cylinder 120 rearward until the cylinder contacts shoulder 139, and causes spring 126 to be compressed between the forward end of hollow shaft 124 and shaft 128 of the frame. The sliding handle 119 also compresses a return spring 141 against frame 111. The sliding handle further comprises a shaft 140 which engages and pivots magazine advancement lever 117. The tip 154 of pawl 152 engages slot 157 in the magazine baseplate 133 to rotate magazine 132 in the manner previously described for the devices of FIGS. 1,7 and 8. As sliding handle assembly 119 reaches its firing position, a release lever 127 on pawl 155 engages a member 156 of the frame 111 to pivot pawl 155 about shaft 114 and withdraw hook 138 from engagement with sear 125. The forward surface of the frame release member 156 is sloped such that it will engage the uppermost corner of pawl release lever 127, to provide maximum releasing leverage to the pawl 155. In similar embodiments (not shown) the pawl is incorporated as a rigid tab or hook on the sliding trigger assembly and guides similar to 118*a–d* are angled slightly downward from front to rear whereby the entire trigger and hook assembly is pulled downward to disengage the plunger.

With pawl 155 withdrawn, the spring 126, compressed within plunger assembly 122, abruptly urges the plunger 122 forward. Friction between piston 123 and cylinder 120 forces the cylinder forward to seal gasket 131 to the magazine baseplate 133. All further forward motion of the plunger 122 drives piston 123 forward within cylinder 120 to force pressurized air from the cylinder outlet end 137 and into the inner passageway 135 of the barrel 134 currently in firing alignment with the cylinder 120, thereby ejecting the projectile 171 from the barrel. The projectile exits the gun 110 through a barrel extension 162.

After the projectile 171 is discharged, the operator releases the trigger-like handle members 115, 142, allowing spring 141 to return the sliding handle assembly 119 to its forward rest position. The sloping forward surface of hook 138 slides over the sloping rearward surface of sear 125, forcing pawl 155 to pivot downward. Once hook 138 is past the sear 125, a spring 143 carried on the sliding handle assembly 119 urges pawl 155 upward to place hook 138 in its rest position in front of sear 125.

Figure 14:
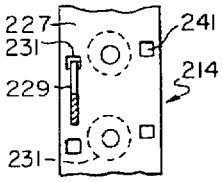
FIG. 14 is a fragmentary end view of the magazine and magazine advancing pawl of FIG. 13, taken in the direction of arrows 14—14.
Figure 15:
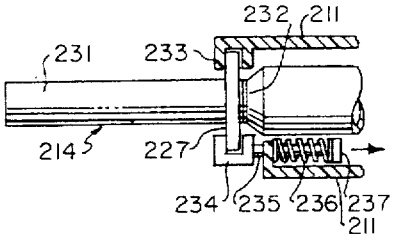
FIG. 15 is a fragmentary view of the apparatus of FIG. 13, taken in the direction of arrows 15—15.

Referring to FIGS. 13, 14 and 15, a variation on the previously described embodiments is shown in which similar cocking and magazine advancing features are incorporated into a plunger assembly. In this embodiment, a projectile launching apparatus 210 comprises a frame 211 upon which are carried an air cylinder 212, a sliding plunger-and-handle assembly 213, a projectile magazine 214, and a magazine advancement lever 215. The cylinder 212 is loosely carried on the frame 211, and may be moved forwardly and rearwardly along guides 224, 225 and 226, with rearward travel being limited by rear protrusions on guides 224 and 226, and forward travel being limited by the baseplate 227 of magazine 214. The plunger assembly 213 comprises a hollow shaft 216, a piston 217 at the forward end of shaft 216, a handle or flange 218 at the rearward end of shaft 216, and forwardly extended arm 219 having a protruding shaft 220 on its forward end. A spring 221 is carried within the hollow shaft 216 with its forward end resting against the inside of the forward end of shaft 216 and its rearward end resting against a shaft 222 which protrudes from the frame 211 into the hollow shaft 216 through slots 223.

An operator of the invention may cock the apparatus 210 by using a hand or other suitable means to keep the frame stationary with respect to the plunger assembly 213 while using another hand or other suitable means to grasp or engage the flange 218 to draw the plunger assembly 213 rearward. As in the previously described embodiments, the operating handle 218 is constrained for straight linear travel, in this case by engagement of piston 217 within cylinder 212 and by shaft 222 in slot 223. As the plunger assembly 213 moves rearwardly the piston 217 drags the cylinder 212 rearward into the protrusions of guides 224 and 226. As the plunger assembly 213 moves further rearward, shaft 220 on arm 219 engages lever 215 to pivot the lever about its mounting shaft 228. Lever 215 raises a pawl 229, pivotally carried on lever 215 by a shaft 230, so that the pawl 229 engages a recess 241 on the magazine baseplate 227 and drives the magazine 214 through a calibrated range of motion to move one barrel 231 out of alignment with the outlet or nozzle end 232 of the cylinder 212 and to move an adjacent barrel 231 into alignment. The magazine is carried by guides 233 on the frame 211 and a movable guide 234. The movable guide 234 is carried by a shaft 235 which extends inside frame 211. A spring 236 on the shaft is compressed between the frame 211 and a flange 237 on the shaft 235, whereby the movable guide 234 is normally urged toward the frame to draw the magazine rearward for engagement with the air cylinder outlet 232. The magazine advancing pawl 229 normally extends from its pivotal mounting shaft 230 both in the direction of magazine advancing motion and in the direction of the magazine 214. Thus as the pawl 229 urges magazine 214 upward, as oriented in FIG. 13, leverage of the magazine 214 on pawl 229 will tend to rotate the pawl counter-clockwise, urging the tip 239 of the pawl and the magazine 214 further forward against the bias of spring 236 on movable guide 234. With the magazine 214 pushed forward as described, the friction between baseplate 227 and nozzle 232 is reduced for the duration of magazine advancing motion.

Once cocked as described above, the apparatus 210 is fired simply by releasing the flange 218 to allow spring 221 to drive the piston 217 away from shaft 222 and forward within the cylinder 212. The cylinder 212 is pushed forward by friction of the piston 217, and at the same time, shaft 220 is moved forward to allow a spring 238 to retract pawl 229, which in turn allows spring 236 to pull the magazine baseplate 227 rearward, whereby the baseplate 227 and cylinder nozzle 232 are forced into mutual engagement. The piston 217 continues forward within the cylinder 212 to force air from the cylinder 212 through nozzle 232 and into the aligned barrel 231 through a rear opening in the baseplate 227, for discharge of a projectile as has been previously described. When configured for firing as described above the apparatus 210 may be used in the construction of "pull-and-release" type devices such as a multi-shot air operated toy bow and arrow, or the firing spring 221 may be omitted and an operator can manually drive the plunger forward by pushing on handle 218.

A releasable latch may optionally be added to the apparatus of FIG. 13 for engagement with an opening in the hollow shaft 216, to retain the plunger assembly 213 in its rearward cocked position. Such a latch may be similar in form and function to the trigger 15 and hook 55 of FIG. 1. In this case, with the plunger assembly 213 drawn rearward, the opening 240 would become aligned with hook 55, whereby hook 55, biased by suitable means would be urged to enter the opening 240 to prevent forward travel of the plunger assembly 213. The apparatus would be fired by pulling on trigger 15 to withdraw hook 55 from the opening 240. When configured for firing as described above the apparatus 210 may be used in the construction of triggered devices such as a multi-shot air operated toy crossbow, armored vehicle, or firearm.

A separate cocking device may be optionally added to actuate the plunger assembly 213. Such a cocking device may be similar in form and function to the handle assembly 19 of FIG. 1. In this case, the shoulder 38 of handle 19 would engage the forward side of flange 218 whereby rearward movement of the handle 19 would cause shoulder 38 to drag plunger assembly 213 rearward as well.

Figure 16:
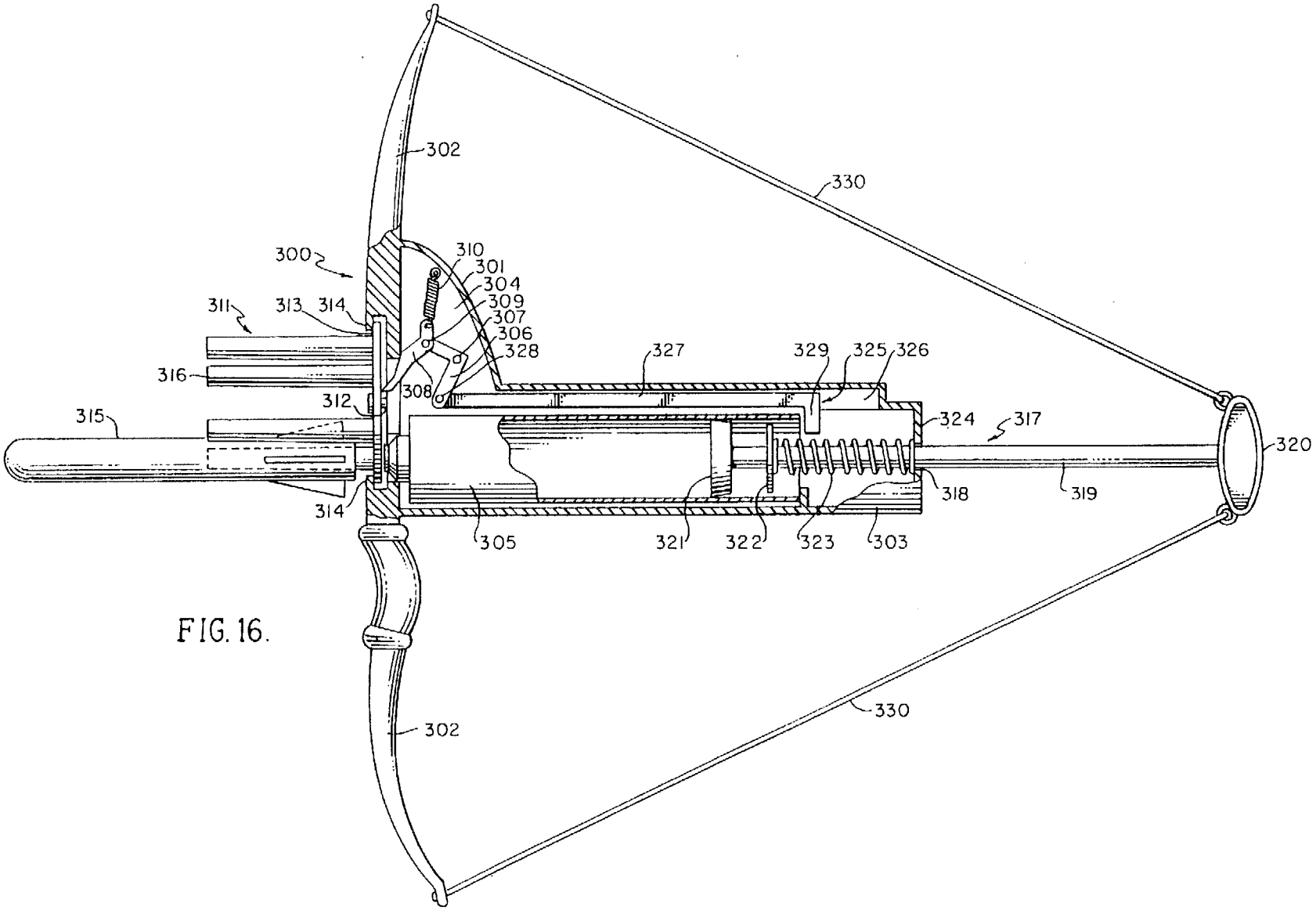
FIG.16 is a side elevational view, partly in section, of a novel bow and arrow type apparatus employing elements of the present invention.

With reference to FIG. 16, elements of the present invention are employed in the construction of a toy bow and arrow apparatus 300 which comprises a frame 301 having bow members 302, an air pump housing 303, and an advancement mechanism housing 304. Within the air pump housing 303, an elongated air cylinder 305 which is movably carried for limited forward and rearward travel as has been described for previously discussed embodiments of the invention. Within the advancement mechanism housing 304, a lever 306 is pivotally carried about a shaft 307 on the frame 301. A pawl 308 is pivotally carried about a shaft 309 on the lever 306. The pawl 308 and lever 306 are biased to rest positions, as depicted, by a spring 310. A cylindrically configured projectile magazine 311, similar to that of FIGS. 7 and 8, is rotatably mounted to the frame 301 about a shaft 312. The magazine baseplate 313 is additionally supported and guided by shoulders 314 on the bow members 302. The magazine is adapted to carry elongated toy arrows 315 on the exterior surfaces of the barrels.

A sliding plunger and handle assembly 317 is carried by an opening 318 at the rear end 324 of the air pump housing 303. The assembly 317 comprises a shaft 319, a handle 320 at the rear end of the shaft, a piston 321 at the front end of the shaft, a flange 322 on a forward portion of the shaft, and a spring 323 carried about the shaft for compression between the flange 322 and the rear end 324 of the air pump housing 303. A linkage 325 is carried within a side chamber 326 of the air pump housing 303. The linkage 325 comprises an elongated member 327 which is pivotally joined to lever 306 by a shaft 328, and a shoulder 329 which extends into the rearward path of flange 322. If the plunger and handle assembly 317 is drawn fully rearward, flange 322 engages shoulder 329 and pulls the linkage 325 rearward, which in turn pivots lever 306 to induce magazine advancement as has been described for previously discussed embodiments.

In FIG. 16 an arrow 315 is depicted on the barrel 316 currently in firing position. If the plunger and handle assembly 317 is driven forward by spring 323, or any other means, piston 321 will urge cylinder 305 forward for sealing engagement with the magazine 311 and force air from within the cylinder 305 and through the aligned barrel 316 to launch the projectile or arrow 315. If however the plunger and handle assembly 317 is drawn from the depicted position to its fully rearward position, flange 322 will actuate the magazine advancement mechanism of 327, 306 and 308, causing the depicted projectile 315 to be rotated out of firing alignment. Thus, once the apparatus 300 has been cocked by the rearward positioning of assembly 317, the magazine 311 may be advanced repeatedly to move any desired barrel 316 into or out of firing alignment by cyclical movement of the plunger and handle assembly 317 over a short range of travel near its fully rearward position.

Note that firing force may be applied to drive the plunger assembly 317 forward by many different means, either individually or in combination. Such means may include but are not limited to: the bias of a spring such as spring 323, resilient stretching of bowstrings 330 connected from the bow members 302 to the assembly 317, resilient bending of the bow members 302, and pushing force applied by an operator to an accessible portion of assembly 317, such as handle 320.

The embodiments depicted herein have employed advancement mechanisms comprising movable magazines to sequentially align a plurality of barrels with an air outlet. However, other embodiments may be constructed in accordance with this invention which employ stationary barrels and wherein the advancement mechanism comprises an air outlet which is sequentially moved to come into successive alignment with the barrels. Therefore it will be understood that herein the term "advancement" refers to either method of sequentially aligning a plurality of barrels with an air outlet.

While particular embodiments of the present invention have been shown and described, it will be obvious to those skilled in the art that changes and modifications may be made without departing from this invention in its broader aspects and therefore the aim in the appended claims is to cover such modifications which fall within the true spirit and scope of this invention.

What is claimed is:

1. An air operated projectile launcher comprising:

a frame;

an air chamber;

a plunger movably carried for travel between a first position and a second position such that movement of said plunger from said second position to said first position causes compression of air within said chamber;

a handle assembly carried for movement on said frame, said handle assembly comprising a handle accessible to an operator for manipulation thereof, said handle assembly cooperating with said plunger for moving said plunger from said first position to said second position;

bearing surfaces on said frame for guiding said handle assembly such that travel of said handle is constrained to a substantially straight linear path with respect to said frame;

an outlet cooperating with said chamber for discharge of air compressed by said plunger;

a plurality of projectile launching barrels attached to a supporting structure, said barrels being selectively alignable with said outlet to receive air discharged from said chamber to launch a projectile carried by a selected barrel;

an advancement mechanism for successive alignment of said barrels with said outlet, said handle assembly cooperating with said advancement mechanism such that operative travel of said handle assembly causes said advancement mechanism to be actuated.

2. The apparatus of claim 1 wherein said handle assembly is intermittently engageable with said plunger for moving said plunger from said first position to said second position and wherein the air operated projectile launcher further comprises a spring biasing said plunger from said second position toward said first position.

3. The apparatus of claim 2 wherein said handle assembly is disengaged from said plunger upon said plunger attaining said second position, whereby said spring is allowed to drive said plunger from said second position toward said first position to compress air within said chamber.

4. The apparatus of claim 3 wherein said frame includes a portion in the general form of a pistol grip and said handle is positioned adjacent said pistol grip to allow said handle and said pistol grip to be simultaneously grasped in a hand of the operator such that said handle and said pistol grip may be squeezed in said hand to cause operative motion of said handle assembly relative to said frame.

5. The apparatus of claim 2 further comprising:

a latch engageable with said plunger to retain said plunger in said second position;

a trigger for releasing said plunger from said latch.

6. The apparatus of claim 4 wherein said handle assembly is carried on said frame generally rearward of said barrels and said handle assembly further comprises an elongated member extending forwardly from the general area of said handle toward said barrels, said elongated member engageable with elements of said advancement mechanism to translate operative motion of said handle assembly into actuation of said advancement mechanism.

7. The apparatus of claim 1 further comprising:

a latch engageable with said plunger to retain said plunger in said second position;

a trigger for releasing said plunger from said latch;

a spring biasing said plunger from said second position toward said first position.

8. The apparatus of claim 1 wherein:

said frame is at least partially hollow and includes an elongated portion;

said handle assembly includes a hollow portion having internal structure adapted to envelop at least part of and be movably carried about said elongated portion of said frame such that mobility of said handle assembly is substantially constrained to linear travel along a longitudinal axis of said elongated portion of said frame;

said handle assembly further includes an advancement actuating member which extends into said frame, said advancement actuating member engageable with said advancement mechanism to translate operative motion of said handle assembly into actuation of said advancement mechanism.

9. A projectile launcher comprising:

a frame, including a portion in the general form of a pistol grip;

a handle assembly carried for movement on said frame, said handle assembly comprising a handle accessible to an operator for manipulation thereof, said handle comprising a member adjacent said pistol grip to allow said member and said pistol grip to be simultaneously grasped in a hand of the operator such that said member and said pistol grip may be squeezed in said hand to cause operative motion of said handle assembly relative to said frame;

bearing surfaces on said frame for guiding said handle assembly such that travel of said handle is constrained to a substantially straight linear path with respect to said frame;

an air compression mechanism;

an outlet cooperating with said air compression mechanism for discharge of compressed air;

a plurality of projectile launching barrels attached to a supporting structure, said barrels being selectively alignable with said outlet to receive air discharged therefrom to launch a projectile carried by a selected barrel;

an advancement mechanism for successive alignment of said barrels with said outlet, said handle assembly cooperating with said advancement mechanism such that operative travel of said handle assembly causes said advancement mechanism to be actuated.

10. The apparatus of claim 9 wherein said handle assembly cooperates with said air compression mechanism such that operative travel of said handle assembly enables said compression mechanism to discharge air compressed thereby from said outlet.

11. A projectile launcher comprising:

a plurality of projectile launching barrels;

a firing mechanism for sequentially launching projectiles from said barrels;

an interface element of said firing mechanism adapted for selective alignment with said barrels to facilitate the launch of a projectile carried by a selected barrel;

an advancement mechanism for successively aligning said barrels with said firing mechanism interface element, said advancement mechanism comprising a wheel carried for rotation about an axis, said advancement mechanism further comprising a driving member movably carried for travel between a first position and a second position;

a plurality of indexing guide sets on a substantially planar side of said advancement mechanism wheel, said indexing guide sets spaced from each other about said axis of rotation in a generally symmetrical arrangement, each of said indexing guide sets comprising a drive surface and an alignment channel;

wherein said indexing guide sets are selectively engageable with said driving member to translate travel of said driving member from said first position to said second position into incremental rotation of said wheel, said driving member in said second position being engageable with said alignment channel of a selected indexing guide set whereby forward and reverse rotation of said wheel is substantially prevented;

and wherein said driving member engages with said drive surface of a selected indexing guide set, whereby travel of said driving member from said first position toward said second position forces said wheel to rotate, travel of said driving member from said first position to said second position and corresponding incremental rotation of said wheel serving to move one of said barrels out of alignment with respect to said firing mechanism interface element and to move an adjacent barrel into alignment with respect to said firing mechanism interface element.

12. The apparatus of claim 11 wherein said firing mechanism comprises a mechanism for compression of air and said firing mechanism interface element comprises an air outlet for discharge of air from said air compression mechanism, said air outlet being adapted for alignment with a selected barrel, whereby air discharged from said outlet is conducted through said barrel to launch a projectile carried by said barrel.

13. The apparatus of claim 12 wherein said air compression mechanism comprises an air chamber and a plunger, said plunger movable for compression of air within said chamber.

14. A projectile launcher comprising:

a frame, said frame comprising a portion in the general form of a pistol grip;

a trigger carried for movement on said frame, said trigger comprising a member adjacent said pistol grip to allow said member and said pistol grip to be simultaneously grasped in a hand of an operator such that said member and said pistol grip may be squeezed in said hand to cause operative motion of said trigger relative to said frame;

bearing surfaces on said frame for guiding said trigger through a substantially straight linear path of travel on said frame;

an air compression mechanism carried on said frame, said air compression mechanism comprising an outlet for discharge of compressed air, said trigger cooperating with said air compression mechanism such that operative travel of said trigger enables said compression mechanism to discharge air from said outlet;

a plurality of projectile launching barrels movably carried on said frame by a supporting structure, said barrels being selectively alignable with said outlet to receive air discharged therefrom to launch a projectile carried by a selected barrel, said barrel supporting structure being carried on said frame for rotation about an axis;

an advancement mechanism for successive alignment of said barrels with said outlet, said advancement mechanism comprising a pawl, said pawl being movable between a first position and a second position, said pawl cooperating with said trigger whereby operative travel of said trigger causes said pawl to move through a barrel advancing range of motion, said advancement mechanism further comprising a plurality of indexing slots symmetrically spaced on said supporting structure about said axis, each of said indexing slots comprising a drive surface and an alignment channel;

wherein said pawl is selectively engageable with said slots to incrementally rotate said supporting structure upon operative travel of said pawl, said pawl in said first position engaging said drive surface of a selected slot, whereby operative travel of said pawl toward said second position forces said pawl against said drive surface such that said slot and said supporting structure must rotate about said axis to allow further displacement of said pawl, said slot adapted so that as said pawl reaches said second position said alignment channel is rotated into substantially longitudinal alignment with the path of operative travel of said pawl, whereby further travel of said pawl along said path applies no substantial rotational force to said slot, said pawl in said second position engaging said alignment channel such that forward and reverse rotation of said barrels and said support structure is substantially prevented.

15. The apparatus of claim 14 wherein said trigger is movable between a rest position and a firing position, said trigger cooperating with said air compression mechanism, whereby travel of said trigger to said firing position enables said compression mechanism to discharge air from said outlet and wherein said pawl cooperates with said trigger, whereby travel of said trigger from said rest position to said firing position causes said pawl to travel from said first position to said second position, engagement of said pawl and said alignment channel substantially preventing rotation of said barrels and supporting structure while said trigger is in said firing position.

16. The apparatus of claim 15 wherein said frame is in the general form of a pistol having said pistol grip toward a rearward portion, a barrel extension at a forward portion, and a breech area generally between said barrel extension and said pistol grip; and wherein said projectile launcher further comprises a projectile magazine carried on said frame in said breech area, said projectile magazine comprising said projectile launching barrels, said supporting structure, and said indexing slots, said barrels being attached to said supporting structure in a cylindrical parallel spaced relationship about said axis of rotation.

17. A projectile launcher comprising:

a frame;

an air discharge mechanism, said air discharge mechanism comprising an outlet through which air is discharged;

a projectile magazine comprising a plurality of barrels in parallel spaced relationship, said magazine movably carried for selective alignment of said barrels with said outlet whereby air discharged therefrom expels a projectile from a selected barrel, said magazine movably carried for travel into and out of sealing engagement with said outlet;

resilient means urging said magazine toward said outlet;

a magazine advancement mechanism for successive alignment of said barrels with said outlet, said magazine advancement mechanism comprising a lever pivotally carried on said frame, said lever comprising a member oriented with respect to said barrels whereby pivotal motion of said lever causes said member to travel through an arcuate path having linear components in a first direction in a plane orthogonal to the longitudinal axes of said barrels and in a second direction parallel to said longitudinal axes, said second direction being perpendicular to said first direction, travel of said member being substantially greater in said first direction than in said second direction for operative travel of said lever;

a pawl pivotally carried by said member whereby pivotal motion of said lever in one direction drives said pawl through an operative range of travel, whereby said pawl engages said magazine to induce advancing motion of said magazine, said pawl oriented to extend from said member in both said first direction and said second direction such that resistance of said magazine to driving force from said pawl urges said pawl to pivot about its mount on said member to extend farther in said second direction for harder engagement with said magazine whereby at least a part of said driving force from said pawl is directed in said second direction to urge said magazine away from said outlet.

18. The apparatus of claim 17 wherein said air discharge mechanism comprises an air chamber and a plunger, said plunger movably carried for compression of air within said chamber.

* * * * *